US006976411B1

(12) United States Patent
Yu

(10) Patent No.: US 6,976,411 B1
(45) Date of Patent: Dec. 20, 2005

(54) EXTENSION TOOL HAVING ANCHORING DEVICE

(76) Inventor: Hsiu-E Yu, P.O.Box 63-298, Taichung 40699 (TW)

( * ) Notice: Subject to any disclaimer, the term of this patent is extended or adjusted under 35 U.S.C. 154(b) by 0 days.

(21) Appl. No.: 10/971,247

(22) Filed: Oct. 25, 2004

(51) Int. Cl.[7] ..... B25B 23/16
(52) U.S. Cl. ..... 81/177.2; 81/177.1; 81/177.9; 81/177.85; 81/177.75
(58) Field of Search ..... 81/177.2, 177.1, 81/177.9, 177.75, 177.85

(56) References Cited

U.S. PATENT DOCUMENTS 6,044,733 A * 4/2000 Liu ..... 81/177.6
6,260,452 B1 7/2001 Yu

* cited by examiner

*Primary Examiner*—Joseph J. Hail, III
*Assistant Examiner*—Shantese McDonald

(57) ABSTRACT

An extension tool includes a shaft having an annular groove and an orifice and an aperture formed in a front portion, to receive a retaining ring and a ball and an insert. A stem is slidably engaged into the shaft and includes a number of depressions for selectively receiving the ball, and for adjustably securing the stem to the shaft. A control ferrule is engaged onto the shaft, and has a protrusion biased to force the ball to engage into either of the depressions of the stem. A spring-biased projection is attached to a rear portion of the stem, and has a detent movable to engage into the aperture of the shaft, to lock the stem to the shaft, and to prevent the stem from being disengaged from the shaft inadvertently.

8 Claims, 6 Drawing Sheets

EXTENSION TOOL HAVING ANCHORING DEVICE

BACKGROUND OF THE INVENTION

1. Field of the Invention

The present invention relates to an extension tool, and more particularly to an extension tool having an extendible stem adjustably attached to an elongate shaft, and having an anchoring device for anchoring the stem, and for limiting a sliding movement of the stem relative to the shaft, and for preventing the stem from being disengaged from the shaft inadvertently.

2. Description of the Prior Art

The applicant has developed various kinds of typical extension tools for facilitating tool driving purposes. For example, U.S. Pat. No. 6,260,452 to Yu discloses one of the typical tools comprising a polygonal rod slidably engaged in a polygonal groove of a shaft, and adjustably secured to the shaft with an outer sleeve, to allow the polygonal rod to be adjustably extended out of the shaft to different outwardly extending positions.

However, there is no lock or anchoring device provided between the polygonal rod and the shaft, such that the polygonal rod may have a good chance to be fully pulled out of the shaft and to be disengaged from the shaft inadvertently.

Particularly, while working, the workers or the users may not pay much attention to pull the polygonal rod out of the shaft, and may thus easily apply too much force against the polygonal rod, and may thus easily pull and disengage the polygonal rod from the shaft inadvertently. It will then take much time for the workers or the users to engage the polygonal rod into the shaft again.

The present invention has arisen to mitigate and/or obviate the afore-described disadvantages of the conventional extension tools.

SUMMARY OF THE INVENTION

The primary objective of the present invention is to provide an extension tool including an extendible stem adjustably attached to an elongate shaft, and having an anchoring device for anchoring the stem, and for limiting a sliding movement of the stem relative to the shaft, and for preventing the stem from being disengaged from the shaft inadvertently.

In accordance with one aspect of the invention, there is provided an extension tool comprising a shaft including a bore formed therein and having a non-circular cross section, and including a front portion having a reduced outer diameter to form a peripheral shoulder in the front portion thereof, and including an annular groove and an orifice and an aperture formed in the front portion thereof, a retaining ring and a ball engaged into and received in the annular groove and the orifice of the shaft respectively, a stem slidably engaged into the bore of the shaft and extendible out of the shaft, and including a number of depressions formed therein, for selectively receiving the ball, and for adjustably securing the stem to the shaft, the stem including a non-circular cross section corresponding to that of the bore of the shaft, to prevent the stem from being rotated relative to the shaft, a control ferrule slidably engaged onto the front portion of the shaft, and including a peripheral protrusion extended radially and inwardly therefrom, for engaging with the ball, and for forcing the ball to engage into either of the depressions of the stem, and thus for adjustably locking the stem to the shaft, the control ferrule including a front portion engageable with the retaining ring, to limit the control ferrule to slide relative to the shaft, and to prevent the control ferrule from being disengaged from the shaft, a spring member engaged onto the front portion of the shaft, and engaged between the peripheral protrusion and the peripheral shoulder of the shaft, to force the peripheral protrusion to engage with the ball, and a spring-biased projection attached to a rear portion of the stem, and having a spring-biased detent movable out of the stem to selectively engage into the aperture of the shaft, in order to lock the stem to the shaft, and to prevent the stem from being disengaged from the shaft inadvertently.

The detent of the spring-biased projection includes an inclined surface formed on top thereof, for allowing the detent of the spring-biased projection to be easily engaged into the aperture of the shaft when the stem is pulled out of the shaft, and to be disengaged from the aperture of the shaft when the stem is moved inwardly into the bore of shaft.

The shaft includes an insert engaged into the aperture of the shaft, to partially block the aperture of the shaft, and to allow the detent of the spring-biased projection to be easily engaged into and disengaged from the aperture of the shaft. The shaft includes an engaging hole formed in a rear portion thereof, for engaging with a driving tool.

A handle may further be provided and attached onto the shaft, to allow the shaft to be firmly held and grasped by users. A spring biasing member may further be provided and disposed between the rear portion of the stem and the shaft, to bias the stem outwardly relative to the shaft.

The stem includes a front portion having an engaging member attached thereto, and a tool element pivotally attached to the stem with the engaging member, to allow the tool element to be rotated relative to the stem. The control ferrule includes an inner peripheral recess formed in the front portion thereof, for receiving the retaining ring, and for limiting the control ferrule to move relative to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
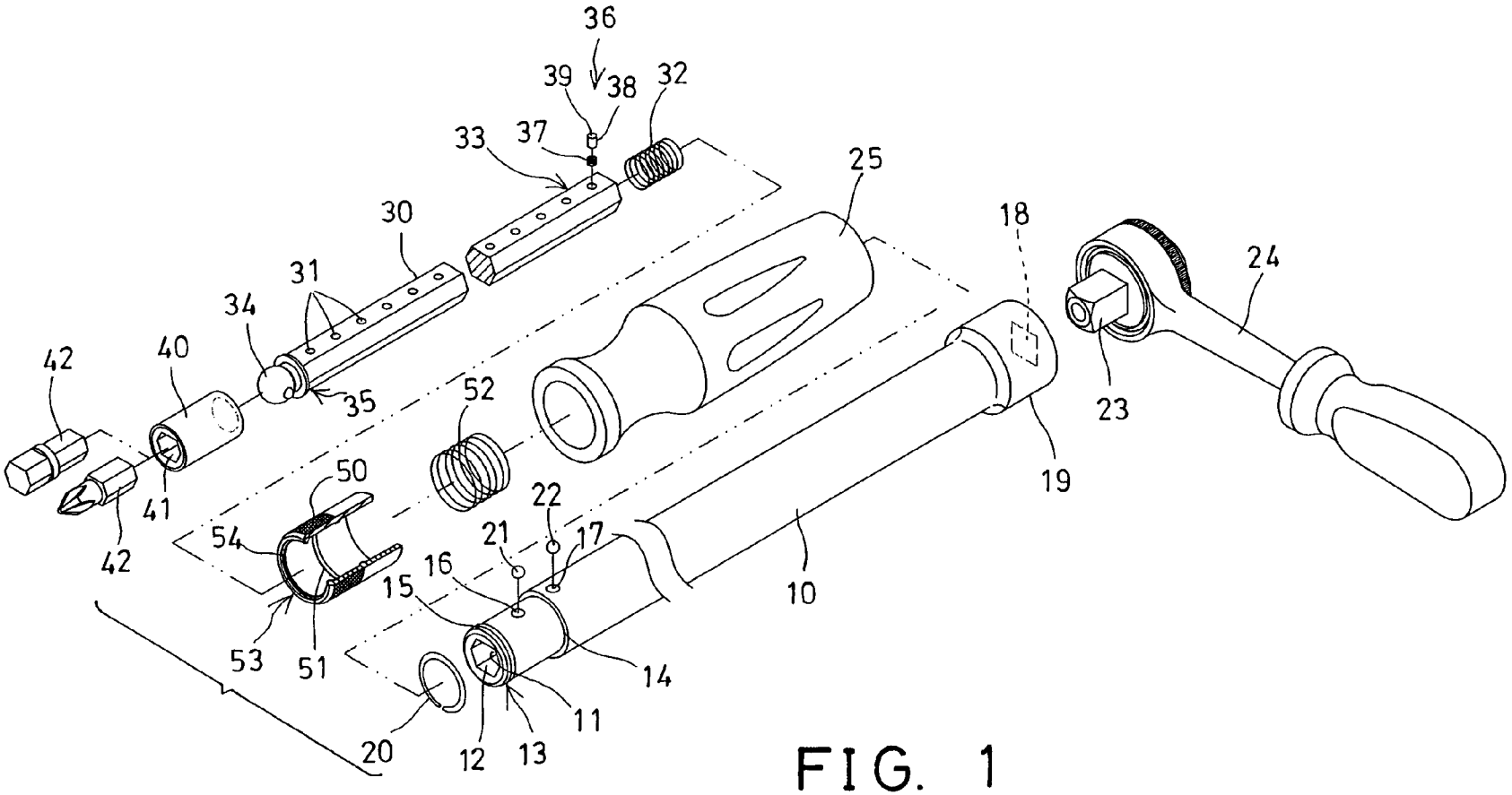
FIG. 1 is an exploded view of an extension tool in accordance with the present invention.
Figure 2:
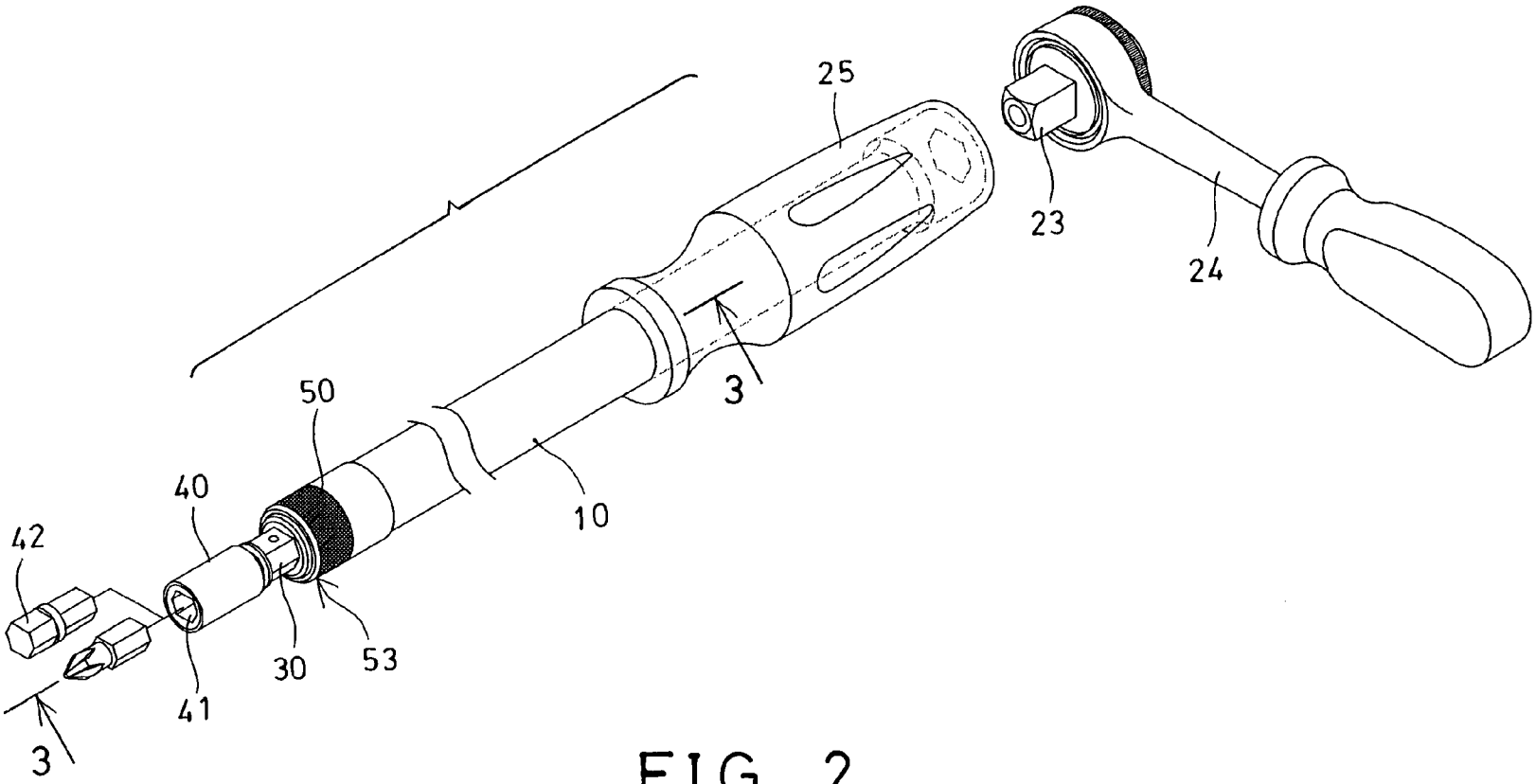
FIG. 2 is a partial exploded view of the extension tool.
Figure 3:
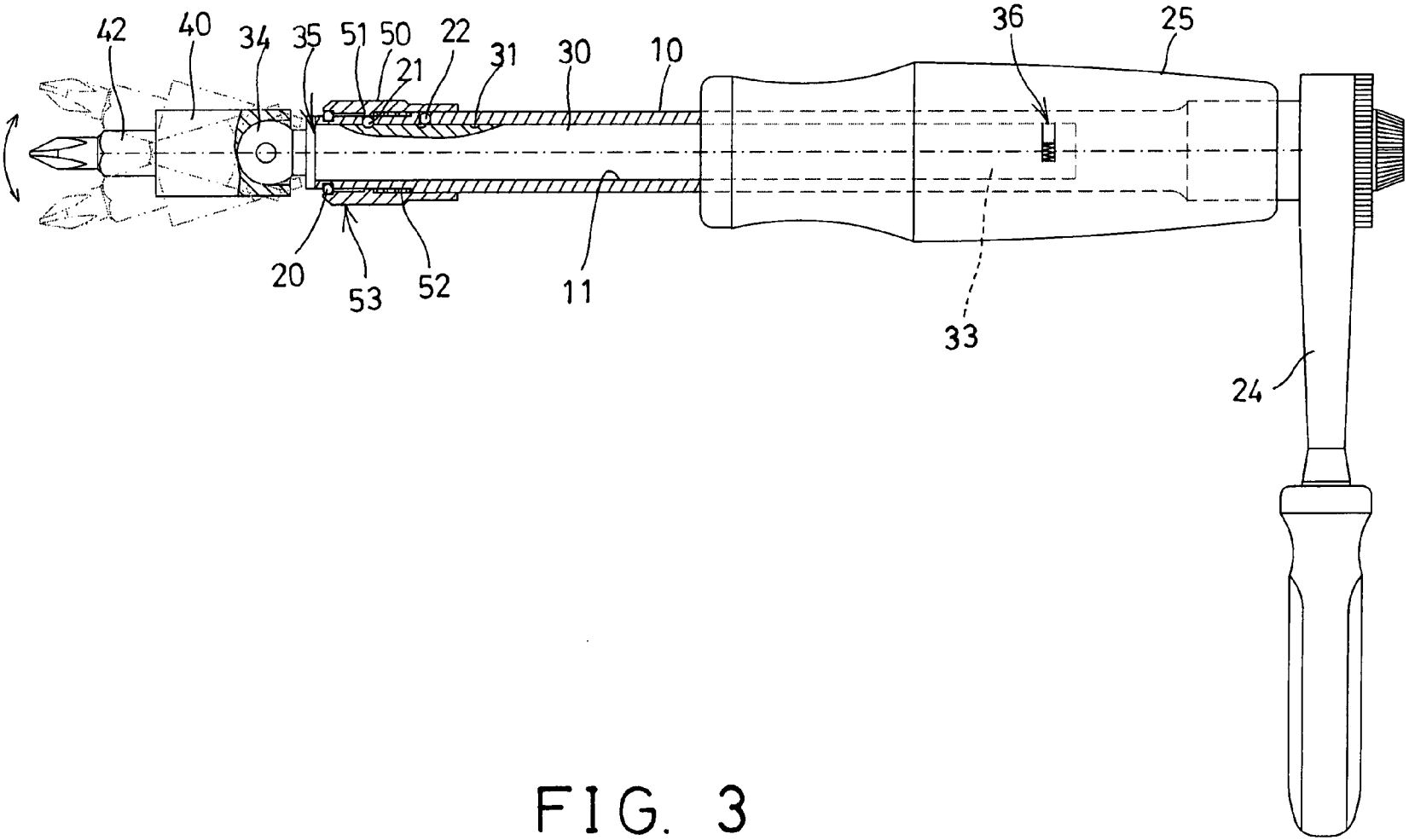
FIG. 3 is a partial cross sectional view of the extension tool, taken along lines 3—3 of FIG. 2.

Referring to the drawings, and initially to FIGS. 1–3, an extension tool in accordance with the present invention comprises an elongate shaft 10 including a bore 11 formed therein and having a non-circular cross section and having an opening 12 formed in a front portion 13 thereof, in which the front portion 13 thereof includes a reduced outer diameter to form or define a peripheral shoulder 14 therein. The shaft 10 further includes an annular groove 15 and an orifice 16 and an aperture 17 formed in the front portion 13 thereof.

A retaining ring 20 and a ball 21 and an insert 22 may be engaged into and received in the annular groove 15 and the orifice 16 and the aperture 17 of the shaft 10 respectively.

The shaft 10 further includes an engaging hole 18 formed in the rear portion 19 thereof, for engaging with or for receiving a driving shank 23 of a driving tool 24, and for allowing the shaft 10 to be rotated or driven by the driving tool 24. A handle 25 may further be provided and attached onto the shaft 10, for allowing the shaft 10 to be easily and firmly held or grasped by the users.

An extendible or slidable stem 30 is slidably engaged into the bore 11 of the shaft 10 via the front opening 12 of the shaft 10, and extendible out of the shaft 10, and includes a number of depressions 31 formed therein and preferably equally spaced away from each other, for receiving the ball 21, and for selectively or adjustably securing the stem 30 to the shaft 10. It is preferable that the stem 30 also includes a non-circular cross section corresponding to that of the bore 11 of the shaft 10, to prevent the stem 30 from being rotated relative to the shaft 10.

A spring biasing member 32 may be disposed between an inner or rear portion 33 of the stem 30 and the shaft 10, to bias or force the stem 30 outwardly relative to the shaft 10. The stem 30 includes an engaging member 34, such as a typical polygonal engaging end or a spherical joint 34 attached to or provided on a front portion 35 thereof, for rotatably or pivotally attaching a socket or a tool element 40 thereto (FIG. 3). The tool element 40 may include an engaging hole 41 formed therein for receiving or engaging fasteners, tool members, tool bits 42, or the like.

A control ferrule 50 is slidably engaged onto the front portion 13 of the shaft 10, and includes a peripheral protrusion 51 extended radially and inwardly therefrom, for engaging with the ball 21, and for forcing the ball 21 into either of the depressions 31 of the stem 30, and thus for adjustably locking and securing the stem 30 to the shaft 10. A spring member 52 may be engaged onto the front portion 13 of the shaft 10, and engaged between the peripheral protrusion 51 and the peripheral shoulder 14 of the shaft 10, to force the peripheral protrusion 51 to engage with the ball 21.

The control ferrule 50 includes a front portion 53 engageable with the retaining ring 20 (FIGS. 3, 5) which may limit the control ferrule 50 to move or to slide relative to the shaft 10, and which may prevent the control ferrule 50 from being disengaged from the shaft 10. It is preferable that the control ferrule 50 includes an inner peripheral recess 54 formed in the front portion 53 thereof, for receiving the retaining ring 20, and for effectively limiting the control ferrule 50 to move or to slide relative to the shaft 10.

The stem 30 further includes a spring-biased projection 36 attached to or received in the rearmost depressions 31 thereof and having a spring member 37 and a detent 38 (FIG. 1) engaged with the spring member 37, for allowing the detent 38 of the spring-biased projection 36 to be biased out of the stem 30 by the spring member 37, and for allowing the detent 38 of the stem 30 to be biased to engage into the aperture 17 of the shaft 10 (FIG. 6), in order to lock the stem 30 to the shaft 10, and thus to prevent the stem 30 from being disengaged from the shaft 10 inadvertently.

Figure 6:
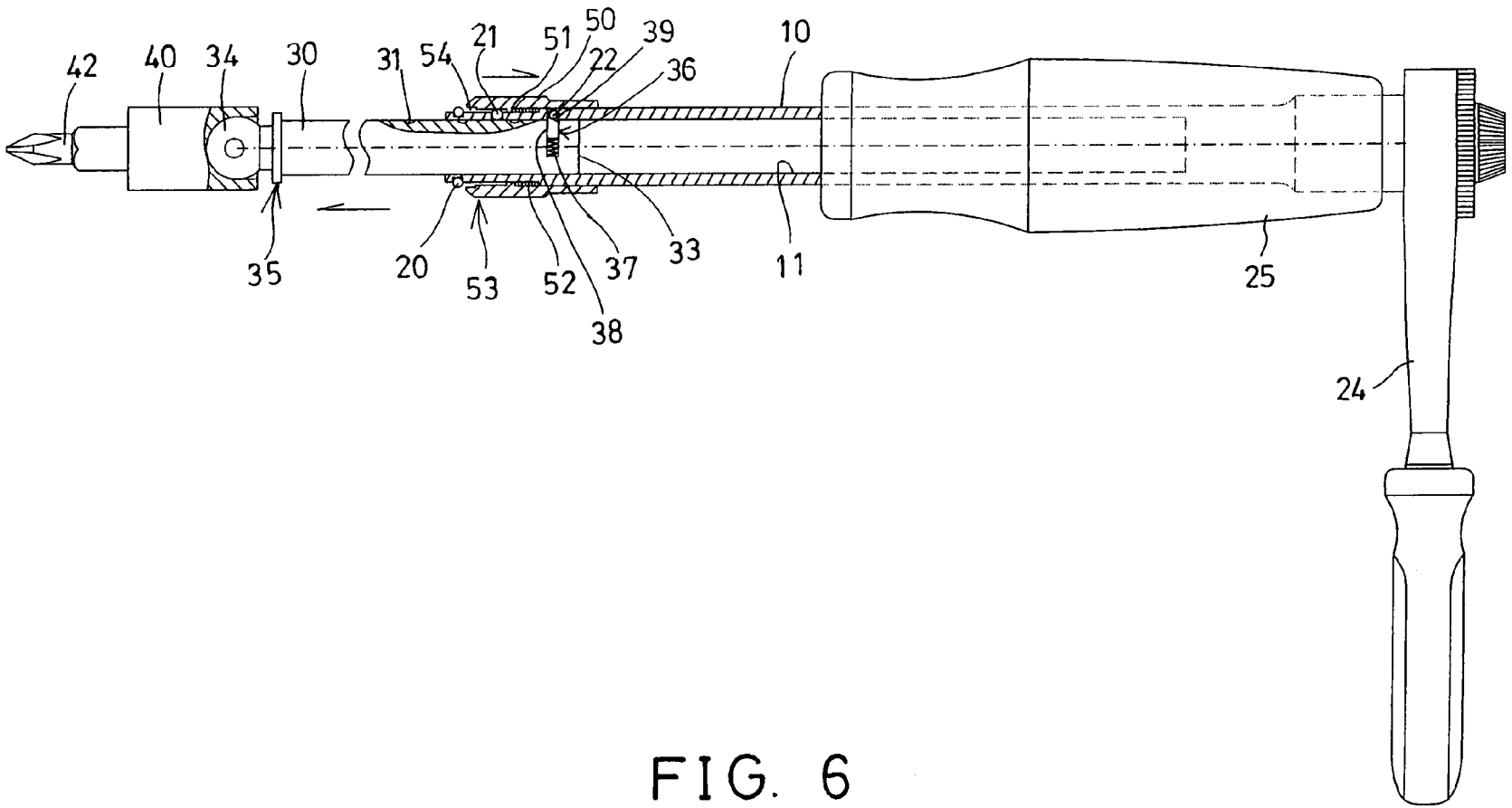

As shown in FIGS. 1 and 6, the detent 38 of the spring-biased projection 36 includes an inclined surface 39 formed on top thereof, for allowing the detent 38 of the spring-biased projection 36 to be engaged into the aperture 17 of the shaft 10 when the stem 30 is pulled out of the shaft 10, and for allowing the detent 38 of the spring-biased projection 36 to be disengaged from the aperture 17 of the shaft 10 when the stem 30 is moved or forced inwardly or into the bore 11 of shaft 10.

It is to be noted that the aperture 17 of the shaft 10 may be easily drilled or punched or formed from outside of the shaft 10, and may be easily and partially blocked by the insert 22, in order to determine the engagement of the detent 38 of the spring-biased projection 36 into the aperture 17 of the shaft 10, and to allow the detent 38 of the spring-biased projection 36 to be easily engaged into and disengaged from the aperture 17 of the shaft 10. Alternatively, the aperture 17 may also be directly formed in the shaft 10, as a blind hole, without engaging the insert 22 into the shaft 10.

In operation, as shown in FIG. 3, the peripheral protrusion 51 of the control ferrule 50 may be biased by the spring member 52 to engage onto the ball 21, and thus to force the ball 21 to engage into either of the depressions 31 of the stem 30, and thus to normally lock and secure the stem 30 to the shaft 10.

Figure 4:
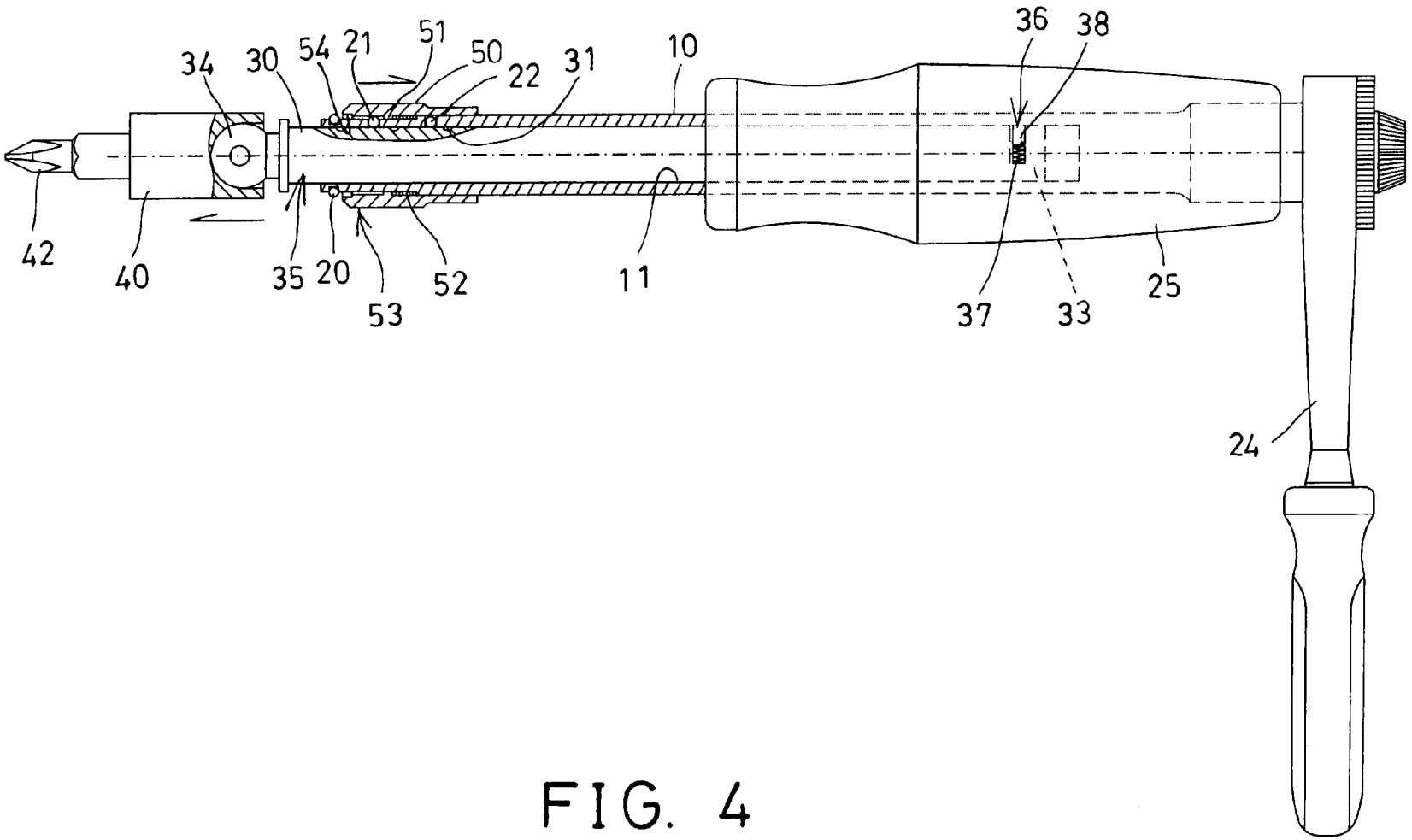
FIGS. 4, 5, 6 are partial cross sectional views similar to FIG. 3, illustrating the operation of the extension tool.

As shown in FIG. 4, when the control ferrule 50 is moved relative to the shaft 10 against the spring member 52 to disengage the peripheral protrusion 51 of the control ferrule 50 from the ball 21, the ball 21 may be disengaged from the depressions 31 of the stem 30 when the stem 30 is moved or slid relative to the shaft 10, to allow the stem 30 to be moved and adjusted relative to the shaft 10 to different extending positions.

Figure 5:
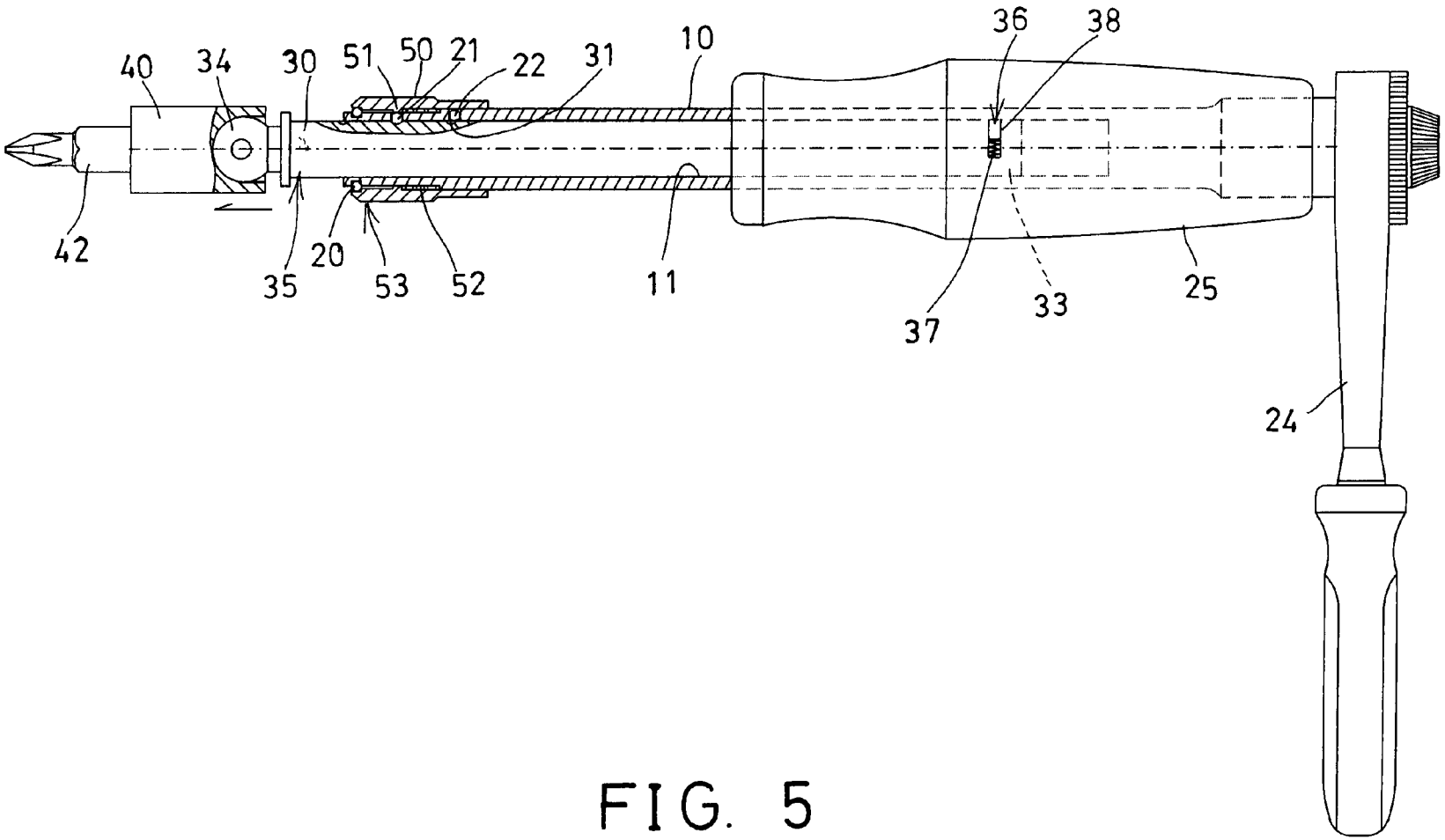

As shown in FIG. 5, when the control ferrule 50 is released, the peripheral protrusion 51 of the control ferrule 50 may be biased by the spring member 52 to engage onto the ball 21 again, and thus to force the ball 21 to engage into the other depressions 31 of the stem 30, and thus to allow the stem 30 to be adjustably locked and secured to the shaft 10 at different extending positions.

As shown in FIG. 6, when the stem 30 is further pulled out or outwardly relative to the shaft 10, the detent 38 of the spring-biased projection 36 of the stem 30 may be biased to engage into the aperture 17 of the shaft 10, and to lock the stem 30 to the shaft 10, and thus to prevent the stem 30 from being disengaged from the shaft 10 inadvertently. The inclined surface 39 formed on top of the detent 38 allows the detent 38 of the spring-biased projection 36 to be disengaged from the aperture 17 of the shaft 10 when the stem 30 is moved or forced inwardly or into the bore 11 of shaft 10.

Accordingly, the extension tool in accordance with the present invention includes an extendible stem adjustably attached to an elongate shaft, and having an anchoring device for anchoring the stem, and for limiting a sliding movement of the stem relative to the shaft, and for preventing the stem from being disengaged from the shaft inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An extension tool comprising:

a shaft including a bore formed therein and having a non-circular cross section, and including a front portion having a reduced outer diameter to form a peripheral shoulder in said front portion thereof, and including an annular groove and an orifice and an aperture formed in said front portion thereof, a retaining ring and a ball engaged into and received in said annular groove and said orifice of said shaft respectively, a stem slidably engaged into said bore of said shaft and extendible out of said shaft, and including a plurality of depressions formed therein, for selectively receiving said ball, and for adjustably securing said stem to said shaft, said stem including a non-circular cross section corresponding to that of said bore of said shaft, to prevent said stem from being rotated relative to said shaft, a control ferrule slidably engaged onto said front portion of said shaft, and including a peripheral protrusion extended radially and inwardly therefrom, for engaging with said ball, and for forcing said ball to engage into either of said depressions of said stem, and thus for adjustably locking said stem to said shaft, said control ferrule including a front portion engageable with said retaining ring, to limit said control ferrule to slide relative to said shaft, and to prevent said control ferrule from being disengaged from said shaft, a spring member engaged onto said front portion of said shaft, and engaged between said peripheral protrusion and said peripheral shoulder of said shaft, to force said peripheral protrusion to engage with said ball, and a spring-biased projection attached to a rear portion of said stem, and having a spring-biased detent movable out of said stem to selectively engage into said aperture of said shaft, in order to lock said stem to said shaft, and to prevent said stem from being disengaged from said shaft inadvertently.

2. The extension tool as claimed in claim 1, wherein said detent of said spring-biased projection includes an inclined surface formed on top thereof, for allowing said detent of said spring-biased projection to be easily engaged into said aperture of said shaft when said stem is pulled out of said shaft, and to be disengaged from said aperture of said shaft when said stem is moved inwardly into said bore of shaft.

3. The extension tool as claimed in claim 1, wherein said shaft includes an insert engaged into said aperture of said shaft, to partially block said aperture of said shaft, and to allow said detent of said spring-biased projection to be easily engaged into and disengaged from said aperture of said shaft.

4. The extension tool as claimed in claim 1, wherein said shaft includes an engaging hole formed in a rear portion thereof, for engaging with a driving tool.

5. The extension tool as claimed in claim 1 further comprising a handle attached onto said shaft, to allow said shaft to be firmly held and grasped by users.

6. The extension tool as claimed in claim 1 further comprising a spring biasing member disposed between said rear portion of said stem and said shaft, to bias said stem outwardly relative to said shaft.

7. The extension tool as claimed in claim 1, wherein said stem includes a front portion having an engaging member attached thereto, and a tool element pivotally attached to said stem with said engaging member, to allow said tool element to be rotated relative to said stem.

8. The extension tool as claimed in claim 1, wherein said control ferrule includes an inner peripheral recess formed in said front portion thereof, for receiving said retaining ring, and for limiting said control ferrule to move relative to said shaft.

* * * * *